US006247958B1

(12) United States Patent
Furusawa

(10) Patent No.: US 6,247,958 B1
(45) Date of Patent: Jun. 19, 2001

(54) FEMALE CONNECTOR FOR IC CARD

(75) Inventor: Tetsuya Furusawa, Miyagi-ken (JP)

(73) Assignee: Alps Electric Co., LTD, Tokyo (JP)

( * ) Notice: Subject to any disclaimer, the term of this patent is extended or adjusted under 35 U.S.C. 154(b) by 0 days.

(21) Appl. No.: 09/437,840

(22) Filed: Nov. 10, 1999

(30) Foreign Application Priority Data

Nov. 16, 1998 (JP) ..... 10-325013

(51) Int. Cl.[7] ..... H01R 13/64
(52) U.S. Cl. ..... 439/374; 439/733
(58) Field of Search ..... 439/374, 842, 439/682, 683, 684, 685, 844, 733.1, 752.5

(56) References Cited

U.S. PATENT DOCUMENTS 4,790,779 * 12/1988 Billman et al. ..... 439/842
5,716,242 2/1998 Myer ..... 439/748

* cited by examiner

*Primary Examiner*—Gary Paumen
*Assistant Examiner*—Alexander Gilman
(74) *Attorney, Agent, or Firm*—Brinks Hofer Gilson & Lione

(57) ABSTRACT

A female connector for an IC card having a housing provided with terminal pin receiving holes provided with positioning projections. Terminal pins each having a base part and contact parts, and inserted in the terminal pin receiving holes are positioned by the positioning projections. A front end portion of the base part of each terminal pin near the contact pin receiving hole is held in a space, the free front end portion of the base part is held in a space between the positioning projections and a side wall of the terminal pin receiving hole to prevent the base part from buckling.

5 Claims, 3 Drawing Sheets

FEMALE CONNECTOR FOR IC CARD

BACKGROUND OF THE INVENTION

1. Field of the Invention

The present invention relates to a female connector for an IC card.

2. Description of the Related Art

FIGS. 5 to 7 show a known female connector for an IC card. Referring to FIG. 5, an IC card C2 comprises a box-shaped cover 21 made of a metal, a printed circuit board 22 provided with a wiring pattern, not shown, and various electrical devices, and a female connector 25 comprising a housing 23 formed by molding a synthetic resin, and a plurality of terminal pins 24. The printed circuit board 22 is fixed in place by a suitable means in the cover 21. The printed circuit board 22 is electrically shielded by the cover 21. The housing 23 of the female connector 25 is fitted in an open end of the cover 21. The terminal pins 24 of the female connector 25 are connected to the wiring pattern of the printed circuit board 22. A plurality of contact pins 26 of an electronic apparatus, not shown, can be inserted into the female connector 25 of the IC card C2 so as to be electrically connected to the terminal pins 24 and pulled out of the female connector 25.

The housing 23 of the known female connector 25 included in the IC card C2 is formed of an insulating material in the shape of a rectangular solid. The housing 23 is provided with contact pin receiving holes 23*a* arranged in two rows so as to open in the front end surface thereof, and terminal pin receiving holes 23*b* connected to the contact pin receiving holes 23*a*, respectively, and opening in a back end surface thereof. The terminal pins 24 are inserted in the terminal pin receiving holes 23*b*, respectively. Each terminal pin 24 is formed by bending a metal plate and has a flat base part 24*a*, an elastic contact part 24*b* continuous with a front portion of the base part 24*a*, a bent part 24*c* continuous with in a back portion of the base part 24*a*, and a terminal part 24*d* projecting from the back end of the base part 24*a* as shown in FIG. 5.

The respective front portions of the base parts 24*a* of the terminal pin 24 are inserted through the open back ends of the terminal receiving holes 23*b* of the housing 23 so that the front ends of the front end parts 24*a* reach near the contact pin receiving holes 23*a* as shown in FIG. 6. In this state, the bent parts 24*c* are forced into the back sections of the terminal pin receiving holes 23*b* and thereby the terminal pins 24 are held on the housing 23, and the front portions of the base parts 24*a* and the contact parts 24*b* are loosely fitted in the terminal pin receiving holes 23*b*.

The contact pins 26 are inserted in and pulled out of the terminal pin receiving holes 23*b* through the contact pin receiving holes 23*a* of the female connector 25. The contact pins 26 inserted through the contact pin receiving holes 23*a* in the terminal pin receiving holes 23*b* are brought into engagement with the contact parts 24*b* of the terminal pins 24, respectively. Thus, the contact pins 26 slide along the contact parts 24*b* of the terminal pins 24 when the same are inserted in and taken out of the terminal pin receiving holes 23*b*. When each contact pin 26 is inserted in the terminal pin receiving hole 23*b*, the free front end portion of the base part 24*a* is raised by frictional force in the direction of the arrow A (FIG. 7). When each contact pin 26 is pulled out of the terminal pin receiving hole 23*b*, the front end portion of the base part 24*a* is depressed in the direction of the arrow B (FIG. 7). Consequently, buckling load is exerted repeatedly on the base part 24*a* of the terminal pin 24 to cause the base part 24*a* of the terminal pins 24 in a short period of use.

Since the front end portion of the base part 24*a* and the contact part 24*b* of the terminal pin 24 of the known female connector for an IC card are loosely fitted in the terminal pin receiving hole 23*b* of the housing 23, the buckling load is exerted repeatedly on the base part 24*a* of the terminal pin 24 by the frictional force exerted by the contact pin 26 on the contact part 24*b* every time the contact pin 26 is inserted in the terminal pin receiving hole 23*b*, whereby the base part 24*a* is buckled and caused to break in a short period of use.

SUMMARY OF THE INVENTION

According to a first aspect of the present invention, a female connector for an IC card comprises: a housing formed of an insulating material and provided with terminal pin receiving holes and contact pin receiving holes continuous with the terminal pin receiving holes; and terminal pins inserted in the terminal pin receiving holes of the housing; wherein the housing is provided with positioning projections for positioning the terminal pins in the terminal pin receiving holes.

Preferably, each positioning projection is spaced a predetermined distance from the side surface of the corresponding terminal pin receiving hole so that a space is formed between the positioning projections and a side wall of the corresponding terminal pin receiving hole, each terminal pin has a base part and contact parts continuous with the base part, each terminal pin is held in the terminal pin receiving hole with a front end portion of the base part thereof placed in the space.

Preferably, the front end portion of the base part of each terminal pin is held in the space at a position near the contact pin receiving hole to position the terminal pin.

Preferably, contact pins capable of being inserted in and pulled out of the contact pin receiving holes are positioned by the positioning projections when the contact pins are inserted in and pulled out of the contact pin receiving holes.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
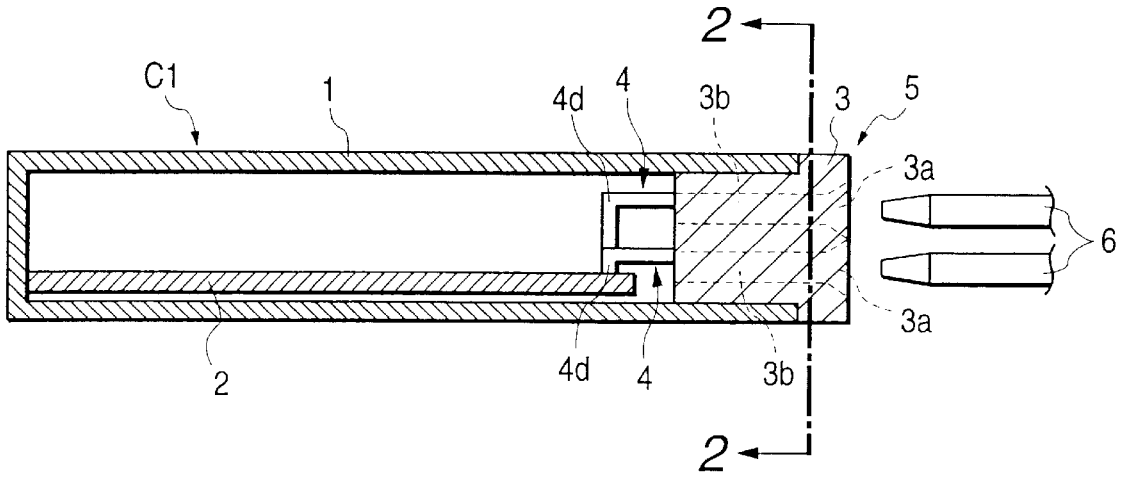
FIG. 1 is a sectional view of an IC card provided with a female connector in a preferred embodiment according to the present invention.

A female connector for an IC card, in a preferred embodiment according to the present invention will be described with reference to FIGS. 1 to 4. Referring to FIG. 1, an IC card C1 comprises a box-shaped cover 1 made of a metal, a printed circuit board 2 provided with a wiring pattern, not shown, and various electrical devices, not shown, and a female connector 5 comprising a housing 3 formed by molding a synthetic resin, and a plurality of terminal pins 4 placed in the housing 3. The printed circuit board 2 is fixed in place by a suitable means in the cover 1. The printed circuit board 2 is electrically shielded by the cover 1. The housing 3 of the female connector 5 is fitted in an open end of the cover 1. The terminal pins 4 of the female connector 5 are connected to the wiring pattern of the printed circuit board 2. A plurality of contact pins 6 of an electronic apparatus, not shown, can be inserted in and pulled out of the female connector 5 of the IC card CI. The contact pins 6 are inserted in the female connector 5 so as to be electrically connected to the terminal pins 4.

Figure 3:
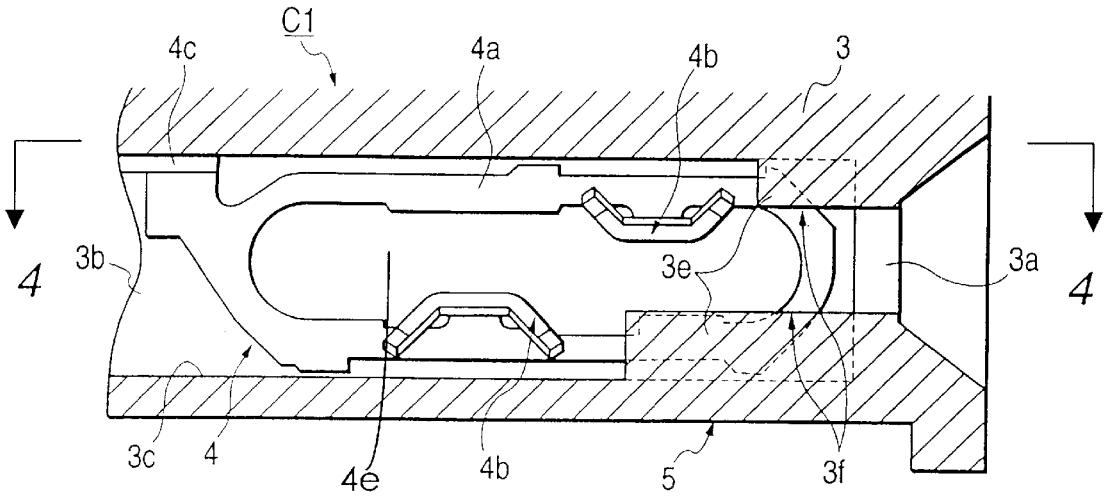
FIG. 3 is a sectional view taken on line 3—3 in FIG. 2.

The housing 3 of the female connector 5 included in the IC card C1 is formed of an insulating material in the shape of a rectangular solid. The housing 3 is provided with contact pin receiving holes 3*a* arranged in two rows so as to open in the front end surface thereof, terminal pin receiving holes 3*b* for receiving the terminal pins 4, connected to the contact pin receiving holes 3*a*, respectively, opening in a back end surface thereof and having a rectangular cross section, and pairs of positioning projections 3*e*. Each pair of positioning projections 3*e* are formed near the contact pin receiving hole 3*a* so as to form a space 3*d* of a predetermined size between a side wall 3*c* of the terminal pin receiving hole 3*b* and the positioning projections 3*e*. As best shown in FIG. 3, the pair of positioning projections 3*e* project from the contact pin receiving hole 3*a* into the terminal pin receiving hole 3*b* and are provided in their middle portions with positioning surfaces 3*f* for positioning the contact pin 6. Each terminal pin 4 is formed by bending a metal plate and has a flat, elliptic base part 4*a*, a pair of elastic contact parts 4*b* formed by bending portions along the inner edges of the base part 4*a*, a bent part 4*c* formed by bending a back portion of the base part 4*a*, and a terminal part 4*d* projecting from the back end of the base part 4*a* as shown in FIG. 1. An opening or hole 4*e* is provided in the base part 4*a* for relieving the buckling strain of the base part 4*a*.

Figure 2:
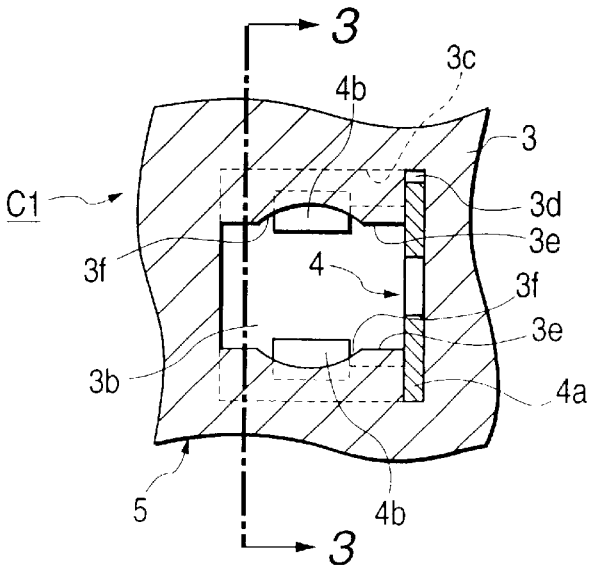
FIG. 2 is a sectional view taken on line 2—2 in FIG. 1.
Figure 4:
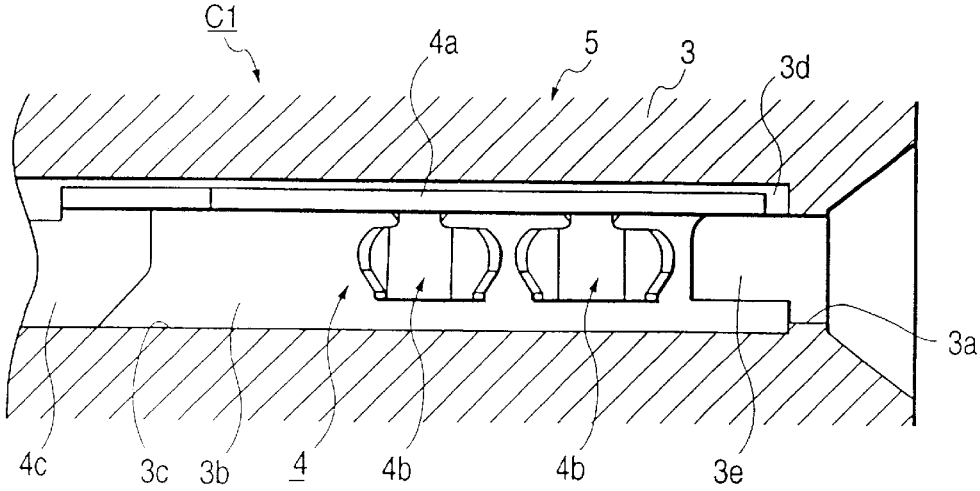
FIG. 4 is a sectional view taken on line 4—4 in FIG. 3.
Figure 5:
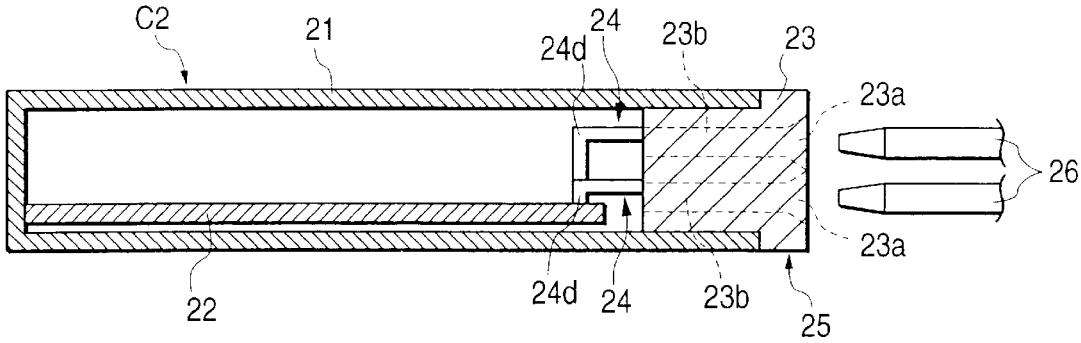
FIG. 5 PRIOR ART
FIG. 5 is a sectional view of an IC card provided with a known female connector.
Figure 6:
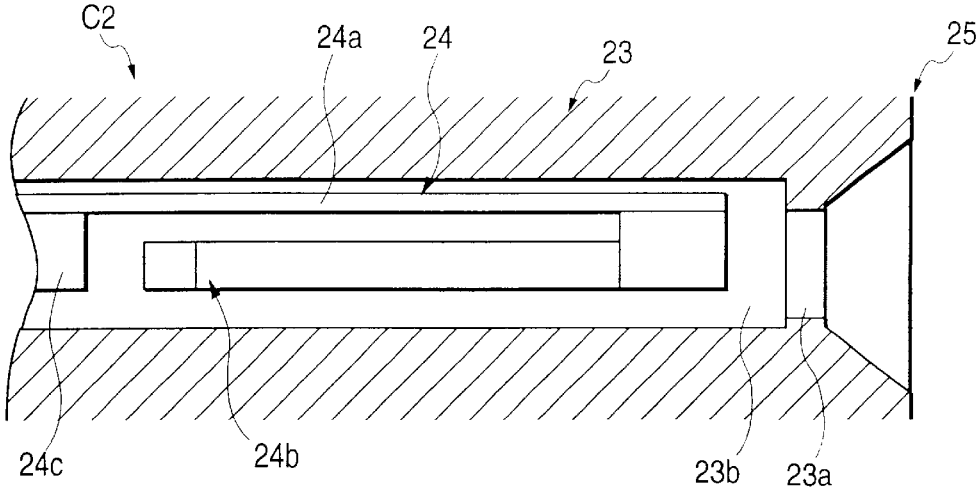
FIG. 6 PRIOR ART
FIG. 6 is a sectional view of an essential portion of the female connector shown in FIG. 5.
Figure 7:
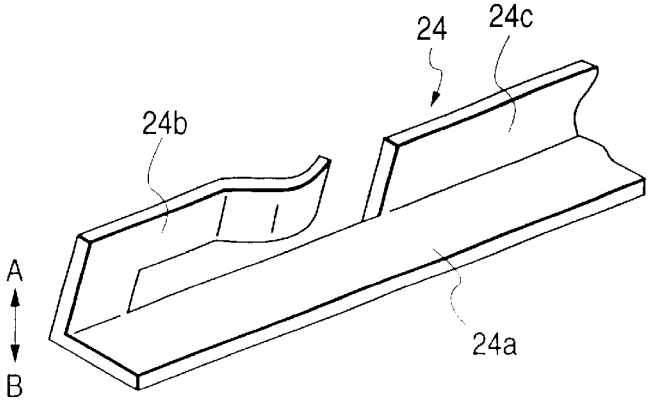
FIG. 7 PRIOR ART
FIG. 7 is a perspective view of an essential portion of a terminal pin included in the female connector shown in FIG. 5.

The terminal pin 4 is inserted in the terminal pin receiving hole 3*b* from the back end of the terminal pin receiving hole 3*b* opening in the back end surface of the housing 3 so as to position the front end of the base part 4*a* near the contact pin receiving hole 3*a* as shown in FIGS. 2 to 4. The bent part 4*c* is forced into a back end section of the terminal pin receiving hole 3*b* to hold the terminal pin 4 in the housing 3. A front end portion of the base part 4*a* positioned near the contact pin receiving hole 3*a* is fitted in the space 3*d* defined by the side wall 3*c* and the positioning projections 3*e*, and the contact parts 4*b* are loose in the terminal pin receiving hole 3*b*.

The contact pins 6 can be inserted in and pulled out of the female connector 5. When the contact pin 6 is inserted through the contact pin receiving hole 3*a* into the terminal pin receiving hole 3*b*, the contact pin 6 is guided correctly by the positioning surfaces 3*f* of the positioning projections 3*e*. Although the contact pin 6 slides along the contact parts 4*b* of the terminal pin 4 when the same is inserted in the terminal pin receiving hole 3*b*, the base part 4*a* is not buckled because the base part 4*a* is held in the space 3*d*.

The contact pin 6 is guided by the positioning surfaces 3*f* when the female connector 5 is separated from the contact pins 6. Therefore, the female connector 5 can accurately be separated from the contact pins 6. Although the contact pin 6 slides along the contact parts 4*b* when the female connector 5 is separated from the contact pins 6, the base part 4*a* is not buckled because the base part 4*a* is held in the space 3*d*.

As apparent from the foregoing description, since the housing 3 is provided with the positioning projections 3*e* to position the terminal pins 4 in the terminal pin receiving holes 3*b* of the housing 3, the base parts 24*a* of the terminal pins 4 are not buckled and the female connector has a long service life.

Since the space 3*d* is formed between the positioning projections 3*e* and the side wall 3*c* of each terminal pin receiving hole 3*b* and the base part 4*a* of each terminal pin 4 is held in the space 3*d*, the female connector is simple in construction and can surely be connected to the contact pins 6.

Since the front end portion of the base part 4*a* of each terminal pin 4 is positioned at a position near the contact pin receiving hole 3*a*, the free front end portion of the base part 4*a* will be firmly held, the base part 4*a* will not be buckled and hence the female connector will have a long service life.

Since the contact pin 6 is guided by the positioning surfaces 3*f* of the positioning projections 3*e* when the same is inserted in and pulled out of the terminal pin receiving hole 3*b*, the female connector is simple in construction and the IC card C1 can accurately be plugged into the electronic apparatus.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A female connector for an IC card, said connector being incorporated into the IC card and connected to a plurality of contact pins provided in an apparatus, said connector comprising:

a housing formed of an insulating material and provided with a plurality of contact pin receiving holes for receiving the plurality of contact pins; and terminal pins arranged in the contact pin receiving holes and electrically connected to one contact pin inserted in the contact pin receiving holes;

each terminal pin comprising a plate-like base part made of metal, and a pair of contact parts formed by bending a part of the base part to be located at positions opposing each other in each contact pin receiving hole and contacting each contact pin;

one end of the base part being electrically coupled to a circuit board provided in the housing, the other end of the base part being a free end, and the pair of contact parts being formed between both ends of the base part;

wherein the housing is provided with a pair of positioning projections corresponding to the contact pin receiving holes, each positioning projection forming a space equivalent to a thickness of the free end of the base part between each positioning projection and an inner wall of each contact pin receiving hole, and a part of the inner wall of one contact pin receiving hole so as to guide each contact pin in the direction of insertion and removal while sliding each contact pin;

the pair of positioning projections are provided to form inner wall surfaces opposing in one receiving hole; and wherein widthwise both ends of the free end of the base part are inserted and fixed to the pair of spaces formed by the pair of positioning projections for positioning each the terminal pin in the direction of the thickness of the base part by each positioning projection.

2. The connector according to claim 1, wherein a receiving port of each contact pin receiving hole corresponding to each contact pin is expanded outwardly.

3. The connector according to claim 1, wherein one of the pair of positioning projections and the other one differ in a depth size from each other, said depth size being in the direction of insertion of the contact pin, and wherein the contact parts differ in the position in the depth direction from each other.

4. The connector according to claim 1, wherein a hole for relieving a buckling strain of the base part is provided.

5. The connector according to claim 1, wherein the contact parts are bent in the direction perpendicular to the base part.

* * * * *